US007096954B2

(12) United States Patent
Weng et al.

(10) Patent No.: US 7,096,954 B2
(45) Date of Patent: Aug. 29, 2006

(54) METHOD AND APPARATUS FOR PLACEMENT OF MULTIPLE FRACTURES IN OPEN HOLE WELLS

(75) Inventors: Xiaowei Weng, Katy, TX (US); J. Ernest Brown, Katy, TX (US); Curtis L. Boney, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/039,019

(22) Filed: Dec. 31, 2001

(65) Prior Publication Data

US 2003/0121663 A1 Jul. 3, 2003

(51) Int. Cl.
*E21B 43/14* (2006.01)
*E21B 43/26* (2006.01)

(52) U.S. Cl. ..... 166/308.1; 166/177.5

(58) Field of Classification Search ..... 166/305.1, 166/308, 177.5, 177.1, 177.2, 317, 191, 147, 166/376
See application file for complete search history.

(56) References Cited

U.S. PATENT DOCUMENTS 1,861,332 A * 5/1932 Waitz ..... 166/185
2,716,454 A * 8/1955 Abendroth ..... 166/308.1
3,062,294 A * 11/1962 Huitt et al. ..... 166/177.5
4,809,729 A * 3/1989 Muddiman ..... 137/68.24
4,995,462 A * 2/1991 Sask et al. ..... 166/304
5,005,649 A * 4/1991 Smith et al. ..... 166/308
5,111,881 A * 5/1992 Soliman et al. ..... 166/250.1
5,318,132 A * 6/1994 Odorisio ..... 166/382
5,425,424 A * 6/1995 Reinhardt et al. ..... 166/291
5,449,039 A * 9/1995 Hartley et al. ..... 166/297
5,890,536 A * 4/1999 Nierode et al. ..... 166/284

* cited by examiner

*Primary Examiner*—Kenneth Thompson
(74) *Attorney, Agent, or Firm*—David Cate; Tim Curington; Robin Nava

(57) ABSTRACT

A method and apparatus is provided for created multiple fractures in a subterranean formation with a single, continuous treatment operation. A plurality of burst disk assemblies are included, each having an independent burst pressure and corresponding to a specific interval to be treated, whereby the assemblies are arranged on a work or completion string such that the assembly with the lowest burst pressure is positioned at the toe, or lowest position, and subsequent assemblies have increasing burst pressures toward the heel of the string. As fluid is pumped down the string, pressure builds up to exceed the burst pressure of the first disk, allowing treatment fluid to contact the formation. Once a first interval treated or fractured, it may be isolated thereby allowing pressure to again build up in the string and burst subseqent disks.

14 Claims, 5 Drawing Sheets

METHOD AND APPARATUS FOR PLACEMENT OF MULTIPLE FRACTURES IN OPEN HOLE WELLS

BACKGROUND OF THE INVENTION

1. Field of the Invention

The present invention relates generally to a method for fracturing a subterranean formation. More specifically, the invention is directed to a method and apparatus for placing multiple fractures in a horizontal or vertical openhole well.

2. Description of the Prior Art

In the recovery of oil and gas from subterranean formations it is common practice to fracture the hydrocarbon-bearing formation, providing flow channels for oil and gas. These flow channels facilitate movement of the hydrocarbons to the wellbore so they may be produced from the well. Without fracturing, many wells would cease to be economically viable.

In such fracturing operations, a fracturing fluid is hydraulically injected down a wellbore which penetrates the subterranean formation. The fluid is forced down the interior of the wellbore casing, through perforations, and into the formation strata by pressure. The formation strata or rock is forced to split or crack open, and a proppant is carried by the fluid into the crack and then deposited. The resulting fracture, with proppant in place to hold the crack open, provides improved flow of recoverable fluid, i.e., oil, gas, or water, into the wellbore.

Fracturing horizontal wells can significantly enhance well productivity, but the cost of multiple fracture completion according to the current industry practice is often unacceptably high. Therefore, operators often choose to complete wells, particularly horizontal wells, as open hole and in some cases, use slotted or preperforated liner or wire wrap screen to maintain hole integrity or provide solids exclusion.

One method currently used for multiple fracture completion is placing the fractures in stages (i.e., one fracture at a time at a wellbore location). Fracturing in stages has the advantage of precise fracture locations and design control, but is relatively expensive. A particular zone or interval is isolated using methods common in the industry, such as using retrievable or drillable bridge plugs with packers, sand or gravel, and a fluid. Well completion consists of setting a bridge plug below each target interval, perforating the target interval, pumping the fracture treatment, and cleaning out any sand remaining in the well bore to prepare for the same process for the next interval. This process repeats until all the target intervals are fractured. The bridge plugs then have to be retrieved or drilled out and well bore cleaned out to proceed with installation of production tubing. In some applications, sand plugs are set in the well bore for fracture isolation in lieu of bridge plugs. This method requires multiple trips into the well during the fracture completion and hence, long rig time and high well completion cost. Special tools have been developed to allow performing multiple tasks, such as setting plug, perforating, fracturing or cleaning, in one pipe trip to reduce rig cost, but at least one trip is required for each interval to be fractured and overall cost is still relatively high.

Another method that is commonly used to create multiple fractures in a single pumping stage is the use of diversion techniques, particularly the limited entry technique. The method of limited entry, such as that described in U.S. Pat. No. 4,867,241 (Strubhar) relies on high perforation entry friction to regulate fluid distribution into multiple perforated intervals. Some or all of the intervals are perforated with a limited number of holes, which causes an increase in pressure at the entrance of the perforations when the fracture treatment is pumped at high flow rate. The high entrance pressure forces fluid to enter multiple intervals, instead of entering only a single interval. Single stage treatment with diversion is less costly but uniform proppant placement is more difficult to achieve in multiple fractures and typically results in decreased well productivity. This is because the earth stress is seldom uniform even within a single rock formation. This causes fractures to be initiated in the lower stress intervals first. Once these fractures are initiated, they become the preferable flow path for the fracturing fluid being injected, leaving other perforated intervals unfractured. Even elevated treating pressure from the limited entry will not entirely mitigate this problem. Furthermore, as proppant enters the perforations, it erodes and enlarges the perforations, which causes the entry friction to decrease rapidly. As a result, the flow distribution among the multiple intervals is drastically altered when the proppant reaches the perforations. This causes a majority of the proppant to be placed only in a few dominant intervals, leaving other intervals unstimulated.

A method for producing multiple fractures from a single operation is described in U.S. Pat. No. 5,161,618 (Jones et al.). A plurality of packers are used to isolate the various intervals to be fractured, then a tool having a plurality of alternate paths or conduits and associated openings is used to supply fracturing fluid to different levels in the isolated interval or section. Each alternate path provided in the apparatus is associated with a specific set of holes or openings in the tool for providing fracturing fluid into the wellbore. Slurry is pumped through the conduits and fills the lower end of the tool prior to flowing into the wellbore, where it creates hydraulic pressure to fracture a first break-down zone. Slurry will continue to flow into this first zone until a bridge is formed or some other impediment to flow is created. At that point, the slurry will flow out of a second set of openings in the tool, which are positioned further up the wellbore to fracture a second break-down zone. However, providing slurry into a new fracture without first providing a clean fluid pad will typically cause the fracture to immediately screen out, thereby prohibiting further treatment of the fracture. Therefore, it would be advantageous to provide an apparatus that allows fracturing fluids to be provided to specific zones or intervals without the need for an alternate path for each zone and wherein the fluid delivered to each zone could be specifically controlled (i.e., providing a pad fluid prior to proppant slurry).

Yet another method for placing multiple fractures in horizontal wells is described in U.S. Pat. No. 6,070,666 (Montgomery). A tool having a packer and tubing for transporting a fracturing fluid and slump-inhibiting materials is used to produce multiple fractures in a horizontal wellbore. The tool is passed into the wellbore and positioned such that the packer may be inflated above a proposed fracture site, to effectively isolate the fracture zone (one end being sealed by the packer and the other end being the outer end of the horizontal well.) Fracturing fluid is then injected via the tubing to produce a fracture in the formation. Once the first fracture is formed, the tool must be withdrawn up the wellbore, where it is again put in place by inflating the packer and the fracturing process is repeated. This process may be used to produce any number of fractures; however, the tool must be moved for each new fracture site. It would be advantageous to provide a tool that could provide multiple fractures in a formation without requiring movement of the tool in the wellbore after each individual fracture was created.

SUMMARY OF THE INVENTION

The present invention is a method and apparatus for producing multiple fractures in a vertical or horizontal well. The tool or apparatus is typically incorporated in, or forms a part of, a completion or work string which is passed into the wellbore. Multiple burst disk assemblies are spaced along the string and serve as fluid entry and fracture initiation points when the fracture treatment is started. Burst disks contained in each assembly are preset at different bursting pressures, with the lowest bursting pressure typically at the toe or distal end of the string. Bursting pressures may increase towards the heel. This allows the disks to burst sequentially, thereby allowing the corresponding intervals to be treated from toe to heel. An advantage of the present invention over the prior art is that a single fluid conduit (i.e., the work or completion string for instance) may provide treatment fluid to a plurality of zones or intervals.

The overall treatment process is continuous, allowing treatment of multiple intervals without the need to stop treatment or to move the tool. The treatment typically includes pumping multiple fluid stages, each corresponding to a specific burst disk assembly. Initially, where the interval to be treated is the first or lowest interval, it may be necessary to form a plug at the end of the liner or string to prevent fluid loss and allow pressure build up in the liner.

As the fluid is pumped, pressure inside the liner or string builds until it exceeds the bursting pressure of the disk corresponding to the interval being treated. Once the disk bursts, the treatment fluid may exit the apparatus and interact with the formation. In the context of a fracturing operation, the fracturing fluid will increase pressure on the formation rock, causing it to fracture. Typically, the fracturing fluid will contain proppant which is pumped into the fracture to maintain permeability once the treatment is completed. Once a sufficient quantity of proppant is pumped into the fracture, it may be necessary to block further flow into the interval.

At the end of each fracture stage, the interval being treated should be blocked off, so the pressure in the liner or string will increase, leading to rupture of the burst disk in the subsequent interval. This may be accomplished using any suitable mechanism, but typically includes either using ball sealers or by forming a proppant plug (i.e., intentionally screening out and packing the treated interval.) If ball sealers are used, they should be dropped near the end of the last proppant stage for each interval. Any excess slurry behind the ball sealers should have a volume less than the wellbore volume between consecutive intervals to ensure that when the next disk ruptures and the corresponding interval starts to take fluid, the fluid entering the new interval is flush or pad fluid instead of proppant laden slurry, which could cause the new fracture to immediately screen out.

Intentional screen out of the fracture may also be used to block off the interval being treated. Typically, this involves decreasing the rate at which slurry is pumped downhole to allow fluid to leakoff into the formation, thereby dehydrating the slurry. This leads to packing of the annulus and blocking of the ruptured disk, effectively preventing further fluid from entering the treated interval.

Once the treated interval has been blocked off, pressure in the apparatus will begin to rise until it exceeds the bursting pressure of the next disk, thereby effectively restarting the cycle. The newly opened interval may then be treated as previously described. In this way, multiple zones or intervals may be treated or fractured in a single, continuous treatment simply by providing a plurality of burst disk assemblies in the tool and repeating the procedure of treating and diverting for each fracture or interval.

To ensure each treatment stage is stimulating the interval adjacent to the corresponding burst disk, a zone isolation method should be employed to block fluid flow in the annulus formed by completion string and openhole to contain the fluid in the interval being treated. The present invention describes an annulus gel plug, mechanical cup packers, and annulus sand plug as three methods to accomplish zone isolation. However, the same may be accomplished using any suitable method known in the industry. The annulus gel plug uses a gel with sufficient strength to resist the fluid flow in the openhole annulus. The gel can have relatively low viscosity to allow it to be placed in the annulus, after which the gel will set or harden over time, thus requiring a relatively large pressure difference in order to cause it to move in the annulus. When a burst disk is ruptured and fluid enters the annulus, the high treating pressure is limited to an area close to the burst disk due to the resistance of the gel, preventing the fracturing fluid entering a different interval. Mechanical cup packers provide direct hydraulic seal against the borehole wall and block the annulus flow. Annulus sand plug formation requires that multiple sand plug tools installed between adjacent burst disk assemblies. The sand plug tool is capable of dehydrating the sand slurry as it flows past the tool and forming a sand plug in the annulus to provide pressure isolation.

The apparatus is thus capable of effectively and efficiently creating multiple fractures or treating multiple zones in a single, continuous treatment operation without requiring movement of apparatus during treatment.

DETAILED DESCRIPTION OF THE PREFERRED EMBODIMENTS

Figure 1:
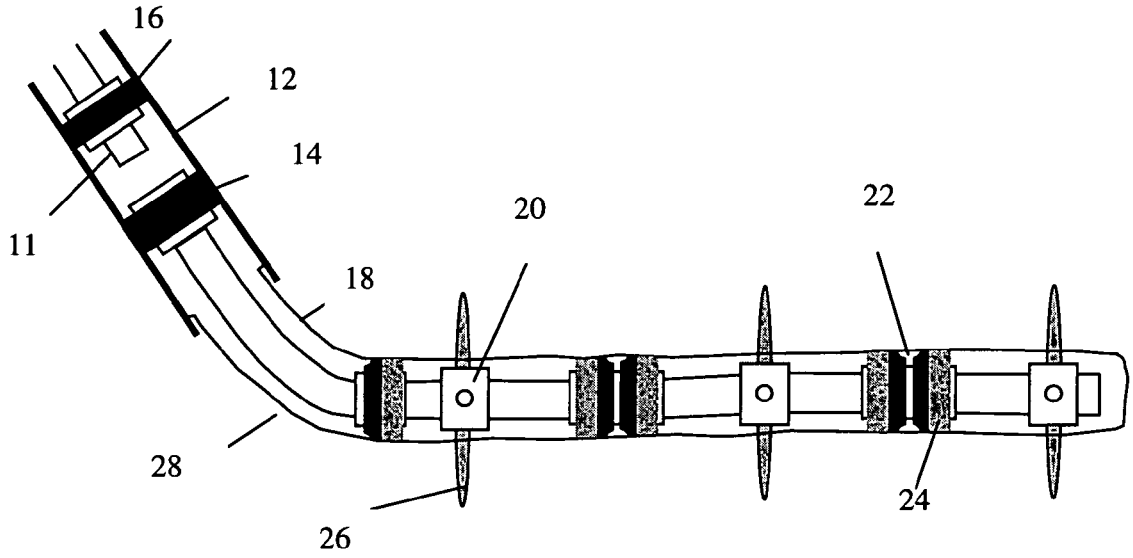
FIG. 1 shows a tool string for providing multiple fractures in a formation.

As shown in FIG. 1, the present invention includes an apparatus 10 for producing multiple fractures 26 in a horizontal or vertical well 18. The apparatus may include a plurality of burst disk assemblies 20 arranged in a spaced configuration along the length of a completion or work string, production liner 28 or other suitable conduit. Generally, the burst disk assemblies 20 are spaced such that they correspond to a specific interval to be fractured or treated. The apparatus is preferably made up at the surface and then passed into the wellbore until it reaches the desired depth. Once the apparatus is in position, the liner hanger 14 is set at or near the end of the casing 12. A treatment tubing 11 with a packer 16 can be run and set above, or stabbed into, the liner to form a conduit for the fracture treatment. In one embodiment, the apparatus 10 may include a mechanism for providing interval or zone isolation. FIG. 1 shows a plurality of sand plug tools 22 for forming sand plugs 24 interspersed between the burst disk assemblies 20 to provide interval isolation.

Figure 2:
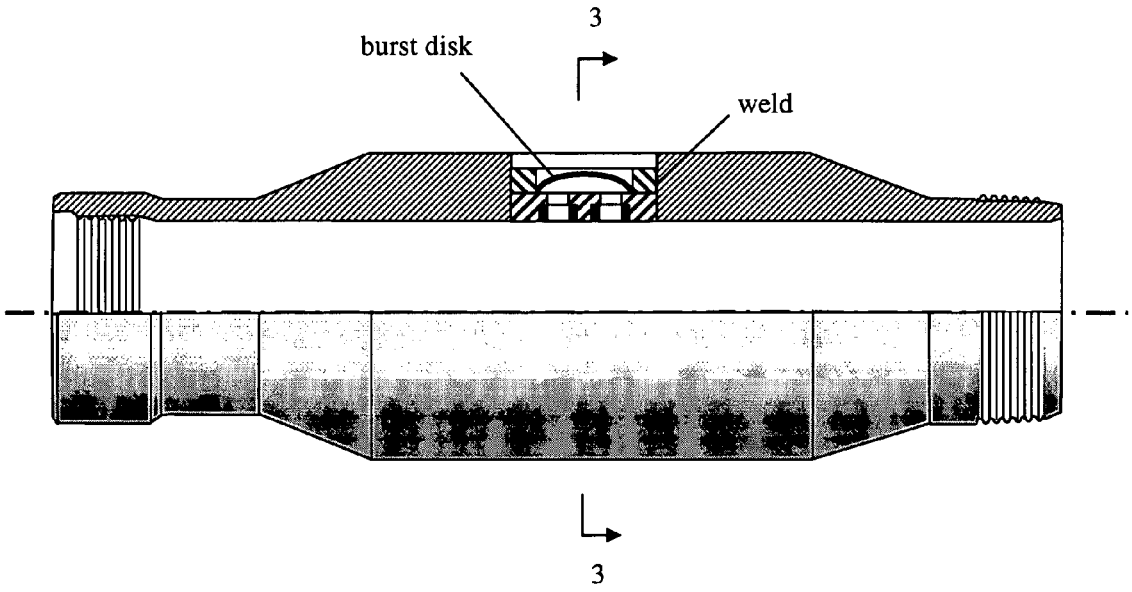
FIG. 2 is a lateral, cut-away view of the burst disk assembly.
Figure 3:
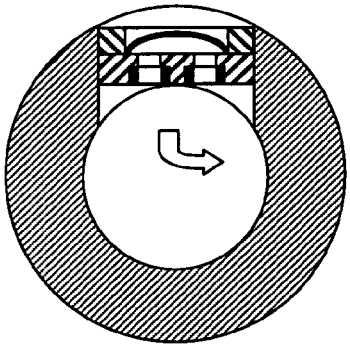
FIG. 3 is a longitudinal, cut-away view of the burst disk assembly.
Figure 4:
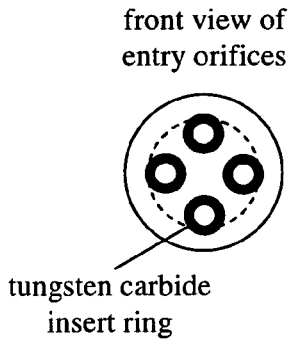
FIG. 4 shows the insert of the burst disk assembly.

As shown in FIGS. 2 and 3, the burst disk assembly 20 is preferably incorporated into a relatively shortened tool section 48 having suitable couplings on each end thereof to allow the tool section to be attached or positioned within a standard completion string or other pipe or liner segments. In a preferred embodiment, the couplings are threaded sections 34, 36. The burst disk assembly comprises a hole 44 formed in the tool wall 50, the tool wall having an internal surface 54 and an external surface 52. A perforated disk 40 having a plurality of holes or orifices 38 and a diameter slightly less than the diameter of the hole 44 is positioned within the hole and attached such that the disk 40 is flush with the internal surface 54 of the tool section 48 thereby maintaining the smooth interior surface of the tool section. The disk may be attached using any suitable method, but is preferably fusion welded. The perforated disk may be formed of any suitable material and may have any suitable number of holes or orifices 38 formed therein. These orifices are preferably of sufficient size and number to allow adequate flow of fluid from the interior bore 32 of the apparatus into the formation. Preferably, the perforated disk is formed of stainless steel. When using proppant laden slurry, the orifice surfaces may be eroded sufficiently to prevent proper sealing of the orifices after treatment particularly if ball sealers are used. Where the treatment fluid being used may cause such erosion, hardened inserts may be mounted or positioned in the orifices to decrease erosion. Preferably, the inserts are formed from tungsten carbide. As shown in FIGS. 2 and 3, the inserts 46 may be countersunk in the perforated disk, and need not extend completely through the disk, as the primary purpose of the inserts is to prevent enlargement of the orifices which would prevent sealing of the orifice with ball sealers, for instance, after the interval has been treated or fractured.

A burst disk 30 is placed between or sandwiched by the perforated disk 40 and a holder or retainer ring 42. The burst disk 30 is preferably a domed metal membrane designed to fail in tension when the differential pressure exceeds the designed bursting pressure. The burst disk may be of any suitable material, but is preferably stainless steel. The bursting pressure of the disk may be varied, for instance, by increasing the thickness of the membrane or changing the material from which the membrane is formed. Once in place between the perforated disk and the retainer ring, the retainer ring may then be attached to the tool section in any suitable manner, but preferably by fusion welding, thereby affixing the burst disk inside the hole 44. The retainer ring 42 should have a sufficient diameter 56 so that is does not obstruct the orifices in the perforated disk.

Figure 5:
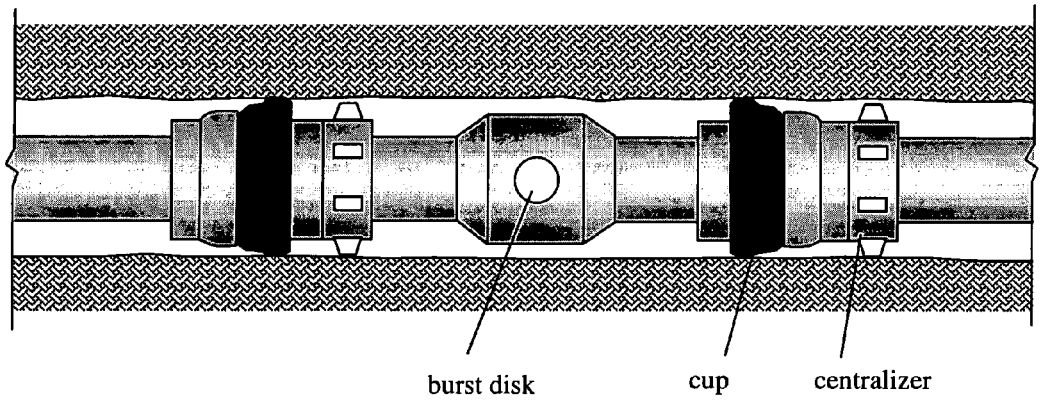
FIG. 5 shows the burst disk assembly and cup packers.

In operation, the apparatus 10 is passed into the wellbore 18 until it reaches a suitable position, such that the burst disk assemblies 20 are positioned to correspond to the specific intervals or zones to be fractured or treated. Preferably, the apparatus will be at least partially supported by a liner hanger 14 or similar device, once the apparatus has been properly positioned. In a preferable arrangement, and as shown in FIG. 5, the burst disk assemblies may be positioned between corresponding cups 60, which are used for interval isolation. Alternatively, the cups may be replaced by a more sophisticated sand plug tool, such as that shown in FIG. 6, which allows formation of sand plugs in openhole annulus to increase the reliability of zone isolation. It should be understood that neither the cups nor sand plug tools are required, but may be included as a preferable isolation mechanism. Once the apparatus is in place, the treatment process may begin.

Prior to fracturing or treating an interval or zone, the interval must be isolated from intervals already treated, as well as intervals yet to be treated. This prevents reopening of treated intervals or premature fracturing of untreated intervals. There are many methods known in the art for interval isolation. Any suitable method may be used in accordance with the present invention. One preferred method for interval isolation is the use of cup packers, as shown in FIG. 5. For each target fracture interval, a pair of cup packers 60 are installed above and below the burst disk assembly 20 and thus isolate the open hole section 80 between the cups 60 from the rest of the borehole 82. The cups provide an interference fit against the wall of the wellbore 84, thereby preventing fluid flow around the cups. Therefore, in a preferred embodiment, the diameter of the cups is slightly larger than that of the wellbore. It may also be desirable to use centralizers 62 to aid in reducing cup wear as the apparatus is run downhole. The centralizers maintain the tool in a centralized position within the wellbore, thereby preventing uneven or undue wear of the cups through excessive contact with the wellbore.

Yet another preferred method for isolating an interval is the use of an annulus gel packer (AGP). The AGP is a non-solids containing polymer chemical system for zonal isolation. Gel is placed in the entire openhole/liner annulus thereby providing sufficient strength to withstand the fracturing pressures and maintain isolation of each interval. However, the gel is not so strong or thick as to inhibit actual fracturing of the formation during treatment. Preferably, gel is passed down the string and into the annulus prior to beginning treatment, thereby allowing the gel to thicken or set sufficiently prior to the start of treatment operations.

Depending on the nature of the formation and the wellbore, it may be necessary to initially form a plug at the end of the liner. This may be accomplished using any suitable method, but typically involves pumping a mechanical plug to land at the liner shoe. Once the plug is formed, the pressure inside the apparatus will rise quickly and the first disk (i.e., the disk with the lowest burst pressure) will burst. The treatment fluid may then enter the openhole annulus causing the formation to fracture. The bursting pressure in subsequent disks should be set well above the expected breakdown and fracturing pressure of the previous intervals, so they will not inadvertently rupture during the preceding fracture treatments. For instance, assuming the interval or zone of interest has a fracture gradient of 0.8 psi/ft., the reservoir pressure gradient is 0.43 psi/ft. and zone TVD is 10,000 ft., the expected differential pressure on the disks during fracturing should be approximately 3700 psi. If the annulus is not completely isolated, the differential pressure could be less. In this example, the disks should have bursting pressures higher than 3700 psi. Preferably, the bursting pressure would be approximately 5000 to 6000 psi.

Treatment of the first zone or interval is preferably carried out according to a designed proppant schedule, thereby ensuring adequate fracturing and propping of the formation interval without bursting or rupturing additional disks. At the end or completion of the interval treatment, the orifices must be blocked off to allow pressure to increase within the apparatus, thereby causing rupture of subsequent burst disks. Any suitable method may be used to block off the orifices; however, in a preferred embodiment, ball sealers are used. In order to seat the ball sealers on the orifices of the perforated disk, the size of the ball sealers should be larger than the size of the orifice. An excess of ball sealers may be dropped in order to ensure that all of the orifices are blocked prior to beginning treatment of subsequent intervals. Ball sealers useful in the present invention include, but are not limited to, conventional rubber coated ball sealers or self-dissolving "bioballs."

Yet another preferred method of blocking off the orifices after a zone has been treated is through the formation of a proppant plug. Proppant plug formation is known in the industry and any suitable method may be employed in conjunction with the present invention. Typically, proppant plug formation involves pumping proppant laden slurry at a reduced rate to allow the slurry to dehydrate through fluid loss to the formation. Here, proppant builds up in and around the perforated disk, effectively blocking further fluid flow there through.

Figure 6:
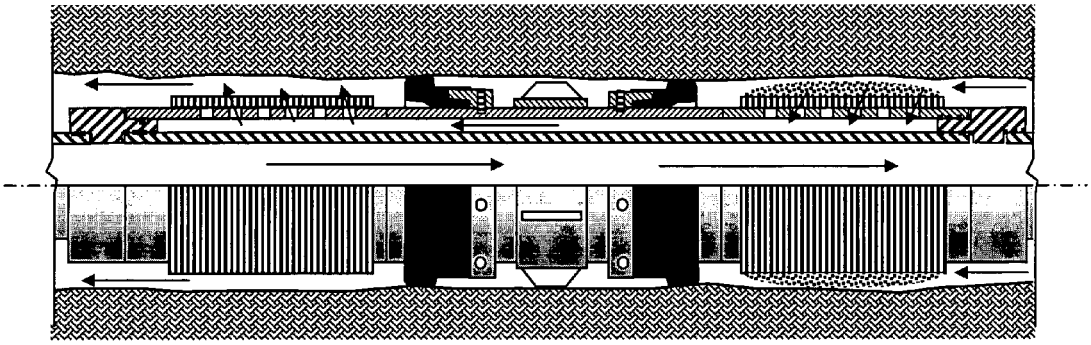
FIG. 6 is a lateral, cut-away view of the sand plug tool.

Yet another preferred method for isolating an interval is the use of a sand plug tool, such as that shown in FIG. 6. The sand plug tool 100 allows the formation of sand plugs 102 by dehydrating a sand-laden slurry when the slurry is pumped through the tool 102. Multiple tools may be installed as components of the completion string between consecutive burst disks as shown in FIG. 1. Each tool includes an inner mandrel 104 and an outer mandrel 106. At least a pair of cups 108 are mounted on the outer mandrel 106. Preferably, the cups are oriented such that they face away from each other. Attached to the outer mandrel 106 and positioned on both sides of the cups 108 are sand screens 110 upon which the sand plug 102 will be formed when sand slurry flows through the screen 110 and tool annulus 112, and exits the other side of the cups. Centralizers 114 may be incorporated into the tool 102 in order to maintain the tool in a centralized position in the wellbore. The inner mandrel 104 is connected with the completion string on both ends via threaded connections. As shown in FIG. 6, sand slurry is pumped down through the completion string or inside of the inner mandrel 116, exits the burst disk down stream of the sand plug tool 100, and back up the annulus between the wellbore and the completion string, finally encountering or contacting the sand screen 110.

We claim:

1. A method for treating a subterranean formation having an uncased borehole formed therein comprising the steps of:

(a) providing a well treatment tool having:

(i) at least first and second burst disk assemblies, wherein said first burst disk assembly has a lower bursting pressure than said second burst disk assembly, (ii) an annulus interval isolation mechanism, (iii) a conduit therein;

(b) passing said tool into the borehole and positioning the tool in a suitable location for treating said formation;

(c) pumping a treatment fluid under pressure through said conduit, said treatment fluid then contacting and rupturing either said first or said second burst disk assembly, said treatment fluid then passing into an isolated annulus interval and treating said formation.

2. The method of claim 1, wherein each burst disk assembly comprises a membrane and a perforated disk.

3. The method of claim 2, further including the step of:

(d) providing a mechanism for blocking fluid flow through the perforated disk.

4. The method of claim 3, wherein the mechanism for blocking fluid flow comprises using ball sealers.

5. The method of claim 1, wherein said well fracturing tool provides a single fluid conduit for providing treatment fluid to multiple annulus intervals.

6. The method of claim 1, wherein said annulus interval isolation mechanism comprises using cup packers.

7. The method of claim 1, wherein said annulus interval isolation mechanism comprises annulus gel packing.

8. The method of claim 1, wherein said annulus interval isolation mechanism comprises a sand plug formation tool.

9. A method for creating multiple fractures in a subterranean formation having an uncased borehole formed therein comprising the steps of:

(a) providing a well fracturing tool for forming a plurality of fractures in the formation having:

(i) at least first and second burst disk assemblies, wherein said first burst disk assembly has a lower bursting pressure than said second burst disk assembly, (ii) an annulus interval isolation mechanism, (iii) a conduit therein;

(b) passing said tool into the borehole and positioning the tool in a suitable location for fracturing said formation;

(c) pumping a fracturing fluid under pressure through said conduit, said fracturing fluid then contacting and rupturing either said first or said second burst disk assembly, said fracturing fluid then passing into an isolated annulus interval and fracturing said formation.

10. An apparatus for treating a subterranean formation having an uncased borehole formed therein comprising:

(a) at least two burst disk assemblies, each assembly comprising a burst disk, wherein a first burst disk assembly has a lower bursting pressure than said second burst disk assembly;

(b) an annulus interval isolation mechanism; and, (c) a conduit therein;

whereby said apparatus is passed into said borehole and positioned in a suitable location for treating said formation; and whereby a treatment fluid is pumped under pressure through said conduit to contact and rupture either said first or said second burst disk assembly, thus enabling said treatment fluid to pass into an isolated annulus interval and treat said formation.

11. The apparatus of claim 10, further comprising a diversion mechanism for selectively preventing fluid flow through the burst disk assemblies.

12. The apparatus of claim 11, wherein said diversion mechanism includes ball sealers.

13. The apparatus of claim 11, wherein said diversion mechanism includes a proppant plug.

14. A method for creating multiple fractures in a subterranean formation having an uncased borehole formed therein comprising the steps of:

(a) providing a well fracturing tool having:

(i) at least first and second burst disk assemblies, wherein said first burst disk assembly has a lower bursting pressure than said second burst disk assembly;

(ii) at least a first and second annulus interval isolation mechanism;

(iii) a conduit therein;

(b) passing said tool into the borehole and positioning the tool in a suitable location for fracturing the formation;

(c) pumping a fracturing fluid under pressure through said conduit, said fracturing fluid then contacting and rupturing either said first or said second burst disk assembly, said fracturing fluid then passing into an isolated annulus interval and fracturing said formation;

(d) providing a mechanism for blocking fracturing fluid flow through said first burst disk assembly; and, (e) repeating steps (c) and (d) to fracture said formation at further target isolated intervals.

* * * * *